United States Patent [19]

Westberg

[11] 4,332,118

[45] Jun. 1, 1982

[54] METHOD AND SUPPORT FOR ANGULARLY ADJUSTING A BUILDING ELEMENT

[75] Inventor: Stefan Westberg, Växjö, Sweden

[73] Assignee: A-Betong AB, Växjö, Sweden

[21] Appl. No.: 193,576

[22] PCT Filed: Aug. 28, 1979

[86] PCT No.: PCT/SE79/00177

§ 371 Date: Apr. 29, 1980

§ 102(e) Date: Apr. 8, 1980

[87] PCT Pub. No.: WO80/00464

PCT Pub. Date: Mar. 20, 1980

[30] Foreign Application Priority Data

Aug. 29, 1978 [SE] Sweden ..... 7809101

[51] Int. Cl.[3] ..... E04B 1/00

[52] U.S. Cl. ..... 52/263; 52/299; 14/16.1

[58] Field of Search ..... 52/167, 723, 573, 299, 52/126, 263; 14/16.1; 248/188.2, 180

[56] References Cited

U.S. PATENT DOCUMENTS

| | | | |
|---|---|---|---|
| 2,308,157 | 1/1943 | Cathrell | 52/299 |
| 2,726,834 | 12/1955 | Hoge | 248/180 |
| 3,325,842 | 6/1967 | Spencer | 14/16.1 |
| 3,349,418 | 10/1967 | Hein | 14/16.1 |

FOREIGN PATENT DOCUMENTS

| | | | |
|---|---|---|---|
| 801730 | 1/1951 | Fed. Rep. of Germany | 14/16.1 |
| 11757168 | 8/1964 | Fed. Rep. of Germany | 14/16.1 |
| 1247368 | 8/1967 | Fed. Rep. of Germany | 14/16.1 |
| 61286 | 10/1969 | German Democratic Rep. | 14/16.1 |
| 285365 | 5/1931 | Italy | 248/188.2 |
| 428826 | 7/1967 | Switzerland | 14/16.1 |
| 13876 | of 1910 | United Kingdom | 248/180 |

*Primary Examiner*—Price C. Faw, Jr.
*Assistant Examiner*—H. E. Raduazo
*Attorney, Agent, or Firm*—Sughrue, Mion, Zinn, Macpeak and Seas

[57] ABSTRACT

In a method of angularly adjusting the position of a building element on a support element, such as a beam (2) on a pillar (1), there is inserted between the mutually facing surfaces of said elements an insert (3) which is operative to transfer pressure from the building element to the support element via an upper surface (3*b*) in engagement with a lower support surface (2*a*) on the building element and a lower surface (3*a*) in engagement with an upper support surface (1*a*) on the support element. The two support surfaces and the two engagement surfaces are formed in a manner such that, in use, two of the surfaces are planar and mutually parallel, the third surface is planar but not parallel with the two first mentioned surfaces, while the fourth surface is a curved surface generated by a straight line. The curved surface is caused to lie against the non-parallel surface. The insert (3) is rotated about an axis (4) perpendicular to one of the planar surfaces such as to obtain the desired angular position between the building element and the support element with line abutment between the curved surface and the planar surface adjacent thereto.

Disadvantages hitherto inherent with the adjustment of building elements on support structures by shimming or packing methods are eliminated, and work at excessive height in connection therewith are avoided.

The invention also relates to a support structure and an insert for use therewith. (FIG. 1)

10 Claims, 12 Drawing Figures

METHOD AND SUPPORT FOR ANGULARLY ADJUSTING A BUILDING ELEMENT

Figure 1:
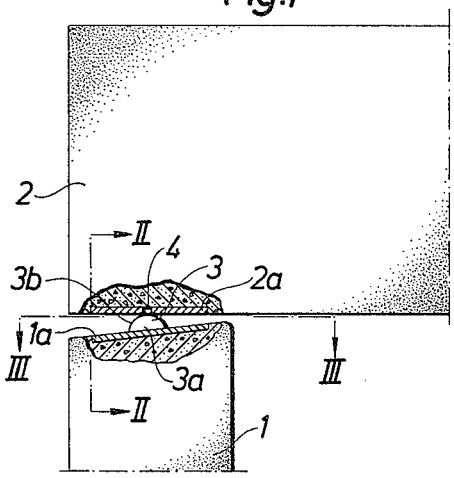

The present invention relates to a method of angularly adjusting a building element on a support, for example a beam on a pillar or bearer.

When mounting, e.g. a beam on a support, it must be ensured that the lateral inclination and/or the direction of the beam relative to the support element is kept within set limits. The task of manufacturing the building elements in a manner such that they conform to the defining surfaces of the jointing locations of the respective support elements within sufficiently narrow tolerances to meet the aforementioned requirements, is very costly and is almost impossible to carry out in practice. Consequently connections between building elements must be provided with intermediate spaces, in which plates, for example, can be inserted, to make vertical and lateral adjustments. This means that the connection zones must be within reaching distance of the builder, which in turn often means that he must work under extremely dangerous conditions, e.g. from high ladders, high platforms etc., in contravention of safety regulations.

At present, adjustments are normally made by packing the joint-spaces with metal shims. This results in poorer joints, inter alia because excessively high interlaminar forces are obtained in the connecting elements.

An object of the invention is to provide a method by which the disadvantages of known padding or shimming methods are overcome, the angle of a building element on a support element can be adjusted in a simple manner without requiring the use of complicated devices, an accurate result can be obtained, which can be readily carried out form the ground even though the actual support location is located at a considerable height above the level of the ground, and which permits continual adjustment of the support-angle in a given plane without impairing the qualities of the subsequently made joint.

Thus according to one aspect, the invention consists in a method of adjusting the angular position of a building element on a support element, e.g. a beam on a pillar or bearer, there being inserted between said elements an insert which acts to transfer pressure from the building element to the support element via an upper surface in engagement with a lower support surface on the building element and a lower surface in engagement with an upper support surface on the support element, characterized in that the two support surfaces and the two engagement surfaces are so formed that at the location of use:

(a) two of the surfaces are planar and mutually parallel;

(b) one surface is planar but not parallel with the surfaces recited in (a); and (c) one surface is a curved surface which is generated by a straight line and which is brought into abutment with the non-parallel planar surface, and in that the insert is so rotated about an axis extending perpendicularly to one of the planar surfaces that the desired angular position of the building element to the support element is obtained through line abutment of the curved surface with an adjacent planar surface.

By rotating the insert, the said angle is continuously adjusted in a given plane. This rotation of the insert can readily be carried out in practice, especially if the building element is being placed in position with the aid of a crane, since then at least some of the weight of said element on the insert can be taken by the crane before said insert is rotated.

The curved surface generated by a straight line hereinafter referred to as the single-curved surface, may be provided on any one of the three elements, i.e. either on the building element, the insert or the support element. Thus, for example, the support element may be provided with an upwardly convex, curved surface generated by a straight line. In this case the insert suitably comprises a wedge-shaped element having a planar upper surface arranged to abut the under surface of the building element, which latter two surfaces thus form said two planar parallel surfaces. The under surface of the wedge-shaped insert is planar and rests against the upper curved surface of the support element.

In a corresponding manner, the single-curved surface may be formed on the lower surface of the building element, in which case the upper surface of the support element is planar and co-acts with one planar surface of the insert.

In certain cases, however, the single-curved surface is preferably formed on the insert, in which case said surface is suitably faced upwardly when positioning said insert.

For the purpose of bracing the elements relative to one another whilst making an adjustment to said angle, the insert is preferably rotated about a peg which passes at least partially through said insert and which is anchored in one of said elements. The peg may be conveniently extended through the insert and accommodated in a recess in the building element.

When the relative angular position of the building and support elements must be adjusted at a considerable height above the level of the ground, the insert can be rotated by means of rods, lines or some other suitable tool, thereby obviating the need of ladders or high platforms etc.

Once the building element has been positioned correctly relative to the support element, the insert need not be touched again. The building element can then be joined to the support element, e.g. by means of concrete, thereby completely or partially enclosing the insert.

According to another aspect the invention consists in a building-element support as claimed in the following claims.

According to a further aspect, the invention relates to an insert arranged to cooperate with said support, the essential features of said insert being disclosed in the following claims.

Exemplary embodiments of the invention will now be described in more detail with reference to the accompanying schematic drawings illustrating the principle aspects of the invention, in which drawings:

FIGS. 1–6 illustrate a first embodiment of a support element according to the invention.

Figure 2:
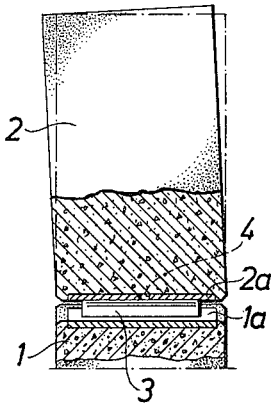
Figure 3:
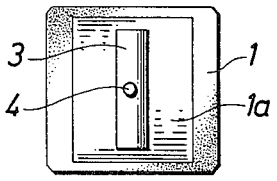

FIGS. 1–3 showing the support element prior to making said adjustment and

Figure 4:
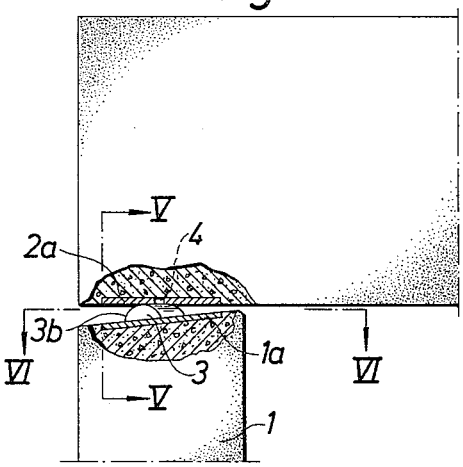
Figure 5:
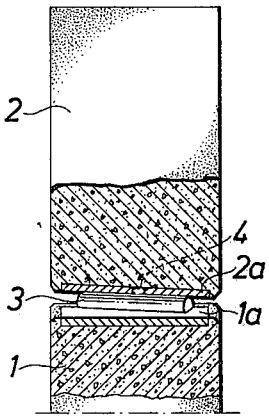
Figure 6:
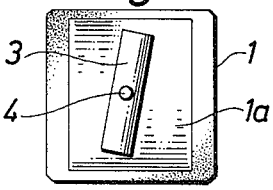
Figure 7:
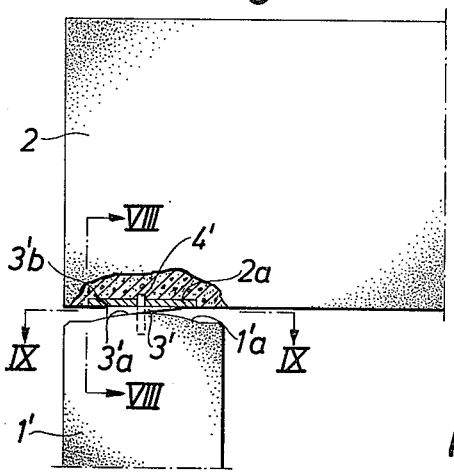

FIGS. 4–6 showing said support element subsequent to said adjustment.

FIGS. 1 and 4 are side views, while

FIGS. 2 and 3 are sectional views taken on the lines 2—2 and 3—3 respectively in FIG. 1, and FIGS. 5 and 6 are sectional views taken on the lines 5—5 and 6—6 respectively in FIG. 4.

FIGS. 7–12 are corresponding views of an alternative embodiment.

Shown in FIGS. 1–6 is a support element 1 in the form of a pillar having an upper support surface 1*a*. The reference 2 identifies a beam having a lower support surface 2*a* and resting on the pillar. Arranged between the beam and the pillar is an insert 3 of semi-circular cross-section with a lower planar surface 3*a* and an upper curved surface 3*b*, which can be considered to be generated by a straight line. FIG. 2 illustrates how the beam 2 supported by the support element 1 deviates from the vertical, shown by dashlines, which means that the beam must be trued relative to the support element. The manner in which this is carried out is illustrated in FIGS. 4–6.

The insert is rotated on a peg 4 which extends through the insert 3 and which is anchored in the pillar 1. Prior to rotating the insert, the weight of the beam 2 on the insert can be taken-up by means of a crane or the like, thereby reducing the force required to rotate the insert. If the support surface of the pillar is located at a considerable height above the ground, the insert can be rotated by means of lines or rods for example, (not shown). The insert is rotated until the beam 2 is correctly positioned relative to the vertical, the angle through which the insert is rotated being made apparent upon comparing FIG. 3 with FIG. 6. The lower support surface 2*a* is still in line-contact with the curved surface 36 of the support element 3. The position of the beam 2 on the pillar 1 has been adjusted in a particularly simple manner, while maintaining a stable support for the post and without requiring the use of shims or corresponding packing plates.

FIGS. 7–12 illustrate a modified embodiment of the invention. In this case, the pillar, here designated 1′, is provided with an upper curved support surface 1′*a* generated by a straight line. The insert, here referenced 3′, has the form of a wedge-shaped element with two planar surfaces 3′*a* and 3′*b* which form an acute angle to one another. The beam is referenced 2 and has a lower planar support surface 2*a*. A centering peg passing through the insert 3 and anchored in the pillar 1′ is referenced 4′.

Figure 8:
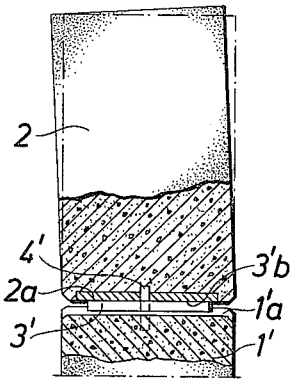
Figure 9:
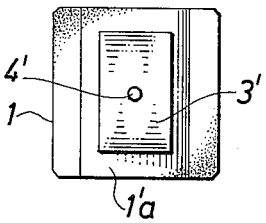
Figure 10:
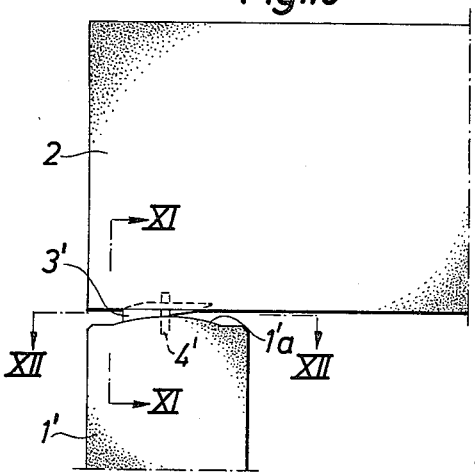
Figure 11:
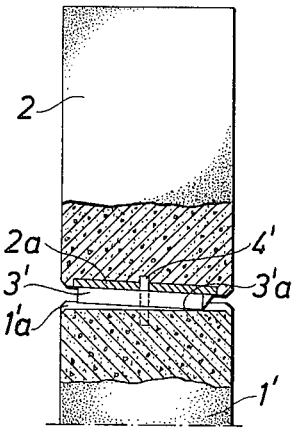
Figure 12:
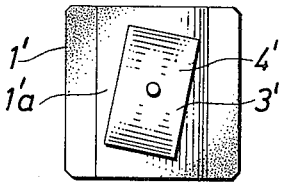

FIG. 8 illustrates how the beam may deviate from the vertical when erected. FIGS. 10–12 illustrate how the position of the beam can be readily adjusted by rotating the insert so that the beam coincides with the vertical plane. Rotation of the insert is illustrated in FIG. 12.

The embodiment of the insert illustrated in FIGS. 7–12 is the one normally preferred, although the embodiment shown in FIGS. 1–6 may be preferable in some cases.

It is also possible to provide the building element, e.g. the beam 2, with a downwardly facing single-curved surface, i.e. a curved surface generated by a straight line. The insert is, also in this case, suitably a wedge-shaped element. The invention is not restricted solely to the case where a beam is supported by a pillar. For example, the concept of the invention can also be applied to adjust the position of various kinds of wall elements relative to a floor structure or a joist structure. The invention affords a valuable advantage when the building element to be supported is of considerable height, since in this case only a slight deviation at the supporting location will result in a considerable deviation at the other end of said element.

As will be understood, the insert may have many different forms and by be made of any suitable material, such as concrete, wood, metal, plastics etc.

The form of the curved surface may also vary. For example, said surface may have an uneven curvature, optionally with one or more discontinuities. The only essential feature is that the form of the curve is such that it can be said to be generated by a straight line, i.e. so that a line-abutment is obtained between said surface and the surface cooperating therewith.

I claim:

1. A method of angularly adjusting a building element on a support element, such as a beam on a pillar, there being inserted between said elements an insert through which pressure from the building element is transmitted to the support element via an upper surface in engagement with a lower support surface on the building element and a lower surface in engagement with an upper support surface on the support element, comprising; forming the upper and lower support surfaces and the upper and lower engagement surfaces so that at the location of use:

(a) two of the surfaces are planar and mutually parallel;

(b) one surface is planar but not parallel with the surfaces recited in (a); and (c) one surface is a curved surface which is generated by a straight line and which is brought into abutment with the non-parallel planar surface; and rotating the insert about an axis extending perpendicularly to one of the planar surfaces so that the desired angular position of the building element to the support element is obtained through line abutment of the curved surface with an adjacent planar surface.

2. A method according to claim 1, wherein the insert is rotated on a peg anchored in said insert or in one of said elements.

3. A method according to claim 2, wherein the insert is rotated by means of a special means, such as a rod or a line.

4. A method according to any one of claims 1–3, characterized in that the insert is provided with two planar non-parallel surfaces.

5. A method according to any one of claims 1–3, characterized in that the upper surface of the insert is said curved surface.

6. A method according to any one of claims 1–3, characterized in that the building element is joined to said support element in the adjusted position of said building element.

7. A support for a building element, comprising; an insert (3, 3′) mounted on a support element (1, 1′), said insert having an upper surface (3*b*, 3′*b*) in engagement with a lower support surface (2*a*) on the building element (2) and having a lower surface (3*a*, 3′*a*) in engagement with an upper support surface (1, 1′*a*) on the support element such that the insert is operative to transfer pressure from the building element to the support element, wherein the upper and lower support surfaces (1*a*, 2*a*, 1′*a*, 2*a*) and the upper and lower engagement surfaces (3*b*, 3′*b*, 3*a*, 3′*a*) comprise (a) two planar and mutually parallel surfaces, (b) a planar surface which is not parallel with the surfaces recited in (a).

(c) a curved surface generated by a straight line; wherein the curved surface abuts the planar non-parallel surface, and wherein the insert is rotatable and operable to assume a position relative to an axis perpendicular to one of the planar surfaces such that the building element adopts a given angular position relative the support element with line abutment between the curved surface and the adjacent planar surface.

8. A support according to claim 7, further comprising a peg (4; 4') on which said insert can be rotated, said peg being anchored in said insert or in a support element.

9. A support according to claim 7 or claim 8, characterized in that the insert (3') exhibits two straight, non-parallel surfaces (3'*a*, 3'*b*), of which one has a central hole for accommodating a peg (4') anchored in a support element.

10. A support according to claim 7 or 8, characterized in that the insert (3) exhibits said curved surface, said surface preferably being the upper surface (36) of said insert.

* * * * *